US008702332B2

(12) United States Patent
Hartstock et al.

(10) Patent No.: US 8,702,332 B2
(45) Date of Patent: Apr. 22, 2014

(54) COSMETIC UNIT WITH SWIVELING CLOSURE

(75) Inventors: Karl Hartstock, Jersey City, NJ (US); Jochen Rauschert, Coburg (DE)

(73) Assignee: GEKA GmbH, Bechhofen (DE)

( * ) Notice: Subject to any disclaimer, the term of this patent is extended or adjusted under 35 U.S.C. 154(b) by 853 days.

(21) Appl. No.: 12/715,579

(22) Filed: Mar. 2, 2010

(65) Prior Publication Data

US 2011/0058889 A1 Mar. 10, 2011

(30) Foreign Application Priority Data

Mar. 2, 2009 (DE) ..... 10 2009 011 026

(51) Int. Cl.
*A46B 11/00* (2006.01)

(52) U.S. Cl.
USPC ..... 401/129; 401/126

(58) Field of Classification Search
USPC ..... 401/126–130, 202, 213, 262, 269; 215/273, 280, 284, 285, 286
See application file for complete search history.

(56) References Cited

U.S. PATENT DOCUMENTS

| | | | | |
|---|---|---|---|---|
| 663,314 | A * | 12/1900 | Weir | 215/286 |
| 705,182 | A * | 7/1902 | Wiese | 215/233 |
| 708,648 | A * | 9/1902 | Karrmann | 215/286 |
| 5,391,011 | A * | 2/1995 | Gueret | 401/126 |
| 6,283,659 | B1 * | 9/2001 | Gueret | 401/122 |

FOREIGN PATENT DOCUMENTS

| | | |
|---|---|---|
| EP | 0610639 B1 | 4/1997 |
| EP | 1038468 B1 | 5/2003 |
| EP | 1347697 B1 | 8/2004 |

* cited by examiner

*Primary Examiner* — David Walczak
(74) *Attorney, Agent, or Firm* — Setter Roche LLP

(57) ABSTRACT

The cosmetics unit (1) comprises a storage container (2) for accommodating a cosmetic substance, an applicator-handle part (3) with an applicator (5) that can be dipped into the cosmetic substance and a handle (6) connected with the applicator (5), as well as a securing mechanism (4) for detachably securing the applicator-handle part (3) in a closed position in which the applicator (5) is inserted into the storage container (2). The securing mechanism (4) comprises a swiveling element (9) that can be swiveled about a swiveling axis (8), which retains, in a final swiveling position, the applicator-handle part (3) in the closed position. The swiveling element (9) is mounted directly on the storage container or on a separate bearing mount (10) attached to the storage container (2).

4 Claims, 12 Drawing Sheets

COSMETIC UNIT WITH SWIVELING CLOSURE

FIELD OF THE INVENTION

The invention relates to a cosmetics unit comprising a storage container for accommodating a cosmetic substance, an applicator-handle part with an applicator that can be dipped into the cosmetic substance and a handle connected with the applicator, as well as a securing mechanism for detachably securing the applicator-handle part in a closed position in which the applicator is inserted into the storage container.

BACKGROUND OF THE INVENTION

Such a cosmetics unit is already known in various embodiments. A corresponding cosmetics unit in which a threaded closure between the applicator-handle part and the storage container is provided as a securing mechanism is described, for example, in EP 1 038 468 B 1. However, its manufacture entails a certain amount of effort. Moreover, the tool tolerances and the many possible variations of storage containers and applicator-handle parts result in partly not inconsiderable differences in the torques required for closing. Therefore, if the machine settings are not adapted exactly to the respective individual case—for example when filling the cosmetics unit—the result may be excessive stress on the thread and thus, the destruction of the cosmetics unit. Furthermore, stiffness and/or an incomplete seal may occur in the case of a screw closure. This can be ascribed, for example, to the pitch of the thread being soiled, which sometimes happens if the cosmetics unit is used not quite properly.

A different cosmetics unit is described in EP 1 347 697 B1 in which the securing mechanism between the storage container and the applicator-handle part is based on a latch-bead-connection. In order to seal the storage container so as to be leak-proof, the closure cap of the applicator-handle part in this embodiment of the cosmetics unit is placed very tightly on the storage container. Thus, the cosmetics unit can only be opened, however, by exerting a not inconsiderable force.

Furthermore, EP 0 610 639 B1 discloses a cosmetics unit with another securing mechanism. A large swiveling clamp is rotatably mounted on the applicator-handle part. In order to secure the applicator-handle part in the closed position, this swiveling clamp can be swiveled about the entire storage container and latched at the underside of the storage container. Thus, the swiveling clamp completely reaches around the storage container in the closed position. Because of this construction, the swiveling clamp is at least as long as the storage container and is therefore difficult to handle. In the opened state, this long swiveling clamp forms the handle of an applicator-handle part. This is awkward to handle. The large swiveling clamp is an impediment in the application of the cosmetic substance. It is in the way, and there is no possibility of swiveling it into a position in which it does not interfere with the application. Furthermore, because of the large swiveling path, automated filling and, in particular, automatic closing of a filled cosmetics unit is not possible, or only with a large effort.

It is thus the object of the invention to provide a cosmetics unit of the type mentioned above which can be handled in a simple and safe manner.

SUMMARY OF THE INVENTION

In the cosmetics unit according to the invention, the securing mechanism comprises a swiveling element that can be swiveled about a swiveling axis and that retains, in a final swiveling position, the applicator-handle part in the closed position, and which is mounted directly on the storage container or on a separate bearing mount attached to the storage container.

Therefore, in the cosmetics unit according to the invention, a secure positional fixing of the applicator-handle part in the closed position is ensured by the swiveling element. In particular, the applicator-handle part also forms the closure member for closing the storage container. The swiveling element provided for securing is designed to be separate from the applicator-handle part so that the swiveling element is neither an interference nor an impediment in the filling of the cosmetics unit, or in the automatic closing of the filled cosmetics unit, or in a later application of the cosmetic substance planned during its intended use. With regard to shape and size, the applicator-handle part virtually does not differ from that of other cosmetics unit provided with a conventional threaded or snap-on closure. The securing mechanism configured as a swiveling mechanism in the cosmetics unit according to the invention comprises a significantly smaller swiveling element, which can thus be handled much more easily than in the prior art according to EP 0 610 639 B1. In the cosmetics unit according to the invention, the bearing mount, which in particular encloses the container opening, is preferably configured independently of the applicator-handle part. They exist as separate partial components of the cosmetics unit that are not connected with each other.

According to a beneficial embodiment, the bearing mount is snapped on the storage container. Such a snap-on process can be carried out automatically very well. In particular, the snap-on connection is configured to be non-detachable, so that, once the bearing mount has been snapped on the storage container, a new partial unit is formed by the storage container together with the bearing mount, which then cannot be removed again. This snap-on process is carried out preferably after the storage container has been filled with the cosmetic substance. This can also be carried out automatically without any problems.

According to another beneficial embodiment, the swiveling axis extends perpendicularly to a central longitudinal axis of the applicator-handle part to be secured. Thus, the swiveling element can also be swiveled in and out if operated with one hand.

According to another beneficial embodiment, the swiveling element and the bearing mount are integrally connected with each other by a film hinge forming a swivel bearing. Such a film hinge, which is common in plastics engineering, is a rugged and very functional swivel bearing. At the same time, the number of components is reduced by such an integral connection of the swiveling element and the bearing mount. This has a beneficial effect on the costs for production and logistics.

According to another beneficial embodiment, the swiveling element or the bearing mount has an accommodating space which partially encloses the handle in the closed position. This ensures that the applicator-handle part does not slip out of the storage container inadvertently. Moreover, it can thus be clearly seen that the cosmetics unit is in its securely closed state.

According to another beneficial embodiment, the swiveling element has a U-shaped cross section comprising two legs of the U and a bottom of the U, with one swiveling support, respectively, being provided in the area of the free ends of the two legs of the U. A very beneficial arcuate swiveling cap can thus be realized, in whose free accommodating space limited by the two legs of the U and the bottom of the U the handle of the applicator-handle part can be accommodated and securely retained.

According to another beneficial embodiment, the swiveling element is configured as a hinged cover that can be folded over the handle. This variant can also be realized easily, and at the same time provides that the applicator-handle part is secured well in the closed position.

According to another beneficial embodiment, the swiveling axis extends parallel to a central longitudinal axis of the applicator-handle part to be secured. Very compact solutions can thus be realized.

According to another beneficial embodiment, the swiveling element is configured as a disc-shaped, in particular flat bar, and the applicator-handle part comprises, in the area of or underneath the handle, a handle recess into which the bar can be swiveled, preferably from the side, in order to reach the securing final swiveling position. The swiveling bar provided in this case is configured very simply. Nevertheless, it achieves a good securing effect.

In another beneficial embodiment, the bar has an arcuate bar recess, preferably in the form of a circular arc, which, starting from a lateral edge of the bar, extends into the bar. In particular, the bar recess in its embodiment in the shape of a circular arc is disposed concentrically with the swiveling axis. Moreover, the applicator-handle part comprises in the area of the handle recess a rod-shaped connecting portion. In the final swiveling position of the bar, this rod-shaped connecting portion is located within the bar recess, i.e. the rod-shaped connecting portion is, in particular, grasped by the bar. The bar recess extends completely through the bar in the thickness direction. This variant causes the applicator-handle part to be secured particularly well. For the result is a double securing action. On the one hand, the disc-shaped bar latches into the handle recess. On the other hand, the rod-shaped connecting portion of the applicator-handle part is also engaged by the bar. This results in the applicator-handle part being secured particularly reliably in the closed position.

According to another beneficial embodiment, the swiveling element is secured in the final swiveling position by means of a detachable latching or snap-in connection. The user can thus recognize when the intended final swiveling position is reached. Preferably, the latch or snap-in action can also be heard or felt. It is thus brought to the user's attention that the secured closed position has been reached. An operating error, such as overtightening of a screw thread, which is possible in the prior art, is thus avoided.

According to another beneficial embodiment, the storage container and the swiveling element and, if present, also the bearing mount, are configured as single-part, in particular injection-molded, unit. This simplifies assembly and reduces the number of components. The single-part unit can in this case comprise, in particular, a film hinge. The film hinge can be provided, in particular, between the bearing mount and the swiveling element. Thus, the swiveling capability of the swiveling element, for example, can be realized in a simple yet very effective manner. In principle, however, the film hinge can be provided at a different location, for example, directly between the storage container and the swiveling element.

An alternative, also very beneficial method of production consists of directly fabricating the bearing mount or the storage container on the one hand and the swiveling element on the other hand together by means of an assembly injection-molding process. An assembly process subsequent to the injection-molding fabrication of the individual parts that would otherwise be required may thus be dispensed with.

Other objects, advantages and details of the invention become apparent from the following description of exemplary embodiments with reference to the drawings.

BRIEF DESCRIPTION OF THE DRAWINGS

Parts corresponding to one another are provided with the same reference numerals in the FIGS. 1 to 13.

DETAILED DESCRIPTION OF THE PREFERRED EMBODIMENTS

Figure 1:
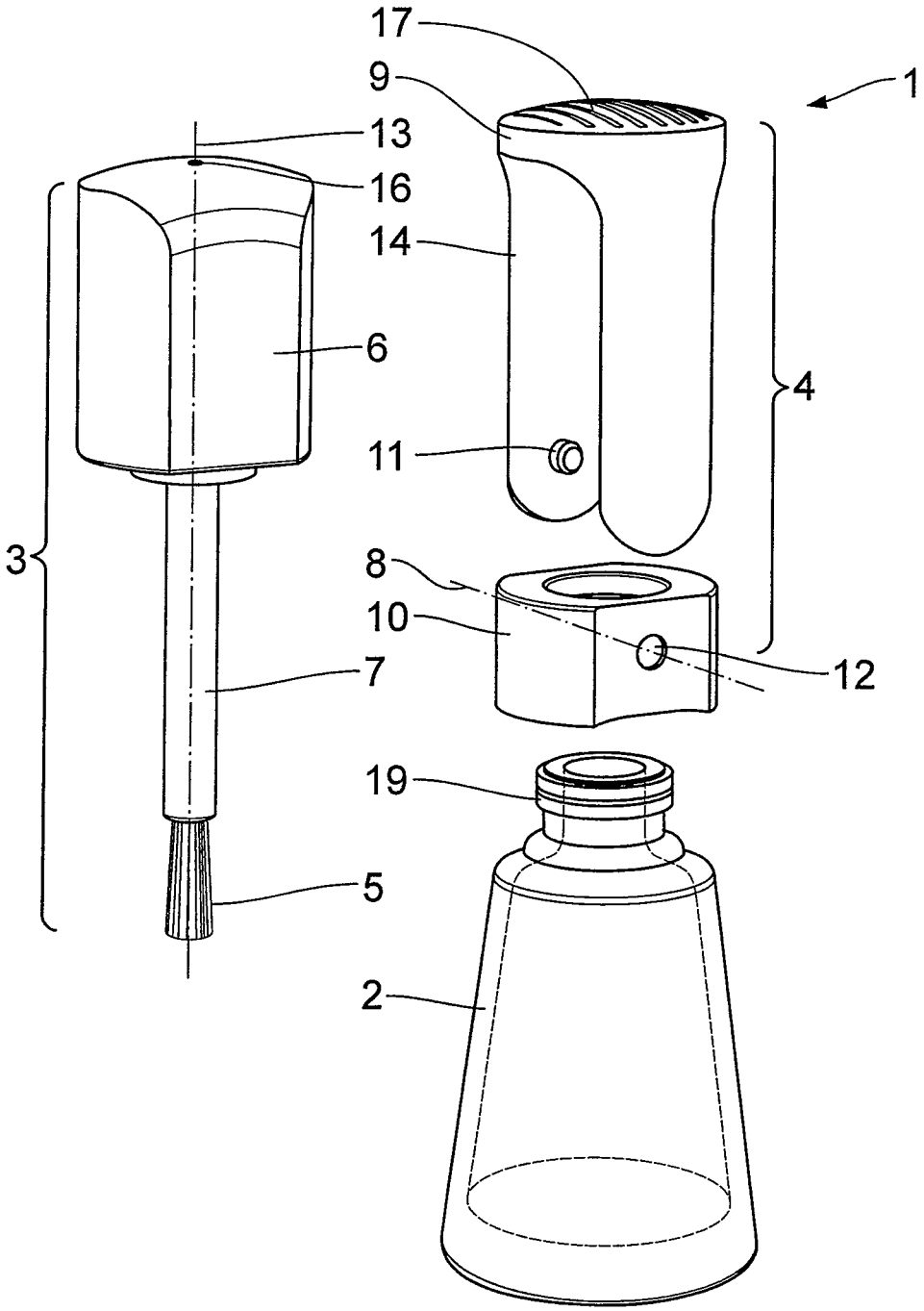
FIGS. 1 to 4 show a first exemplary embodiment of a cosmetics unit with a U-shaped swiveling mechanism for securing a closed state in a component view, a longitudinal section view and in two views of states of use with different swiveling positions of the swiveling mechanism.
Figure 2:
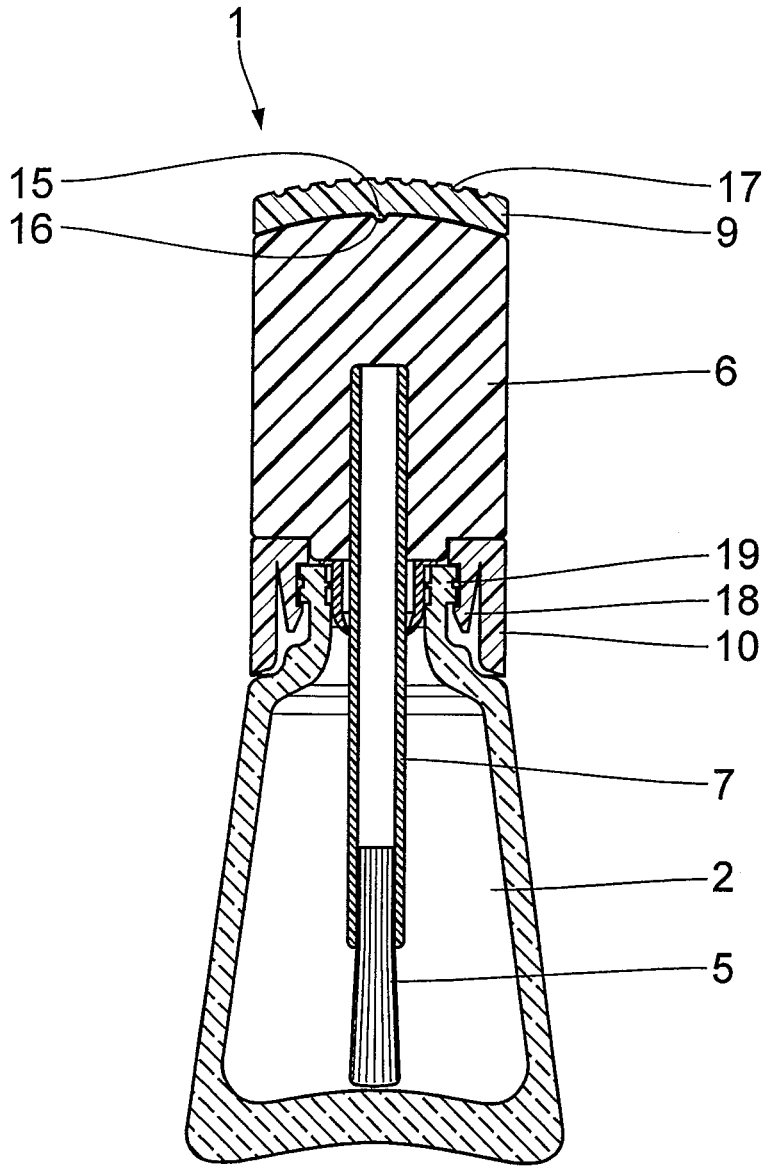

FIGS. 1 to 4 show an exemplary embodiment of a cosmetics unit 1, which, in addition to a storage container 2 provided for receiving a cosmetic substance, such as a nail polish or lipstick fluid and an applicator-handle part 3, also comprises a securing mechanism 4 for securing a closed position of the cosmetics unit 1. The cosmetics unit 1 is made from plastic. The applicator-handle part 3 is composed of an applicator, which in the exemplary embodiment is a brush, intended for applying the cosmetic substance, a handle 6 and a stem 7 connecting the applicator 5 with the handle 6. At the same time, the applicator-handle part 3 also forms the closure member of the storage container 2.

The securing mechanism 4 configured as a swiveling mechanism comprises a U-shaped swiveling element 9 rotatably mounted about a swiveling axis 8, as well as a bearing mount 10. The swiveling element 9 comprises two legs of a U connected with each other by means of a bottom of the U. In the area of the free ends of these legs of the U, bearing pins 11 engaging into associated bearing recesses 12 on the bearing mount 10, whereby the swiveling bearing of the securing mechanism 4 is formed, are provided on their respective inside, that is, the side facing the respective other leg of the U. The U-shaped swiveling element 9 can thus be swiveled about the swiveling axis 8, the position of which is determined by the bearing pin 11 and the associated bearing recesses 12. Thus, the swiveling axis 8 is oriented perpendicularly to a central longitudinal axis 13 of the applicator-handle part 3 and also of the entire cosmetics unit 1.

An accommodating space 14, the inner contour of which is adapted to the outer contour of the handle 6 of the applicator-handle part 3, is formed between the two legs of the U and the bottom of the U of the swiveling element 9 and the bearing mount 10. In the closed position, the U-shaped swiveling element 9 grasps the handle 6 of the applicator-handle part 3 inserted into the storage container 2, so that the handle 6 lies within the accommodating space 14. In this securing final swiveling position of the U-shaped swiveling element 9, the longitudinal direction of the two legs of the U of the U-shaped swiveling element 9 is oriented parallel to the central longitudinal axis 13.

Moreover, a latching connection between the U-shaped swiveling element 9 and the handle 6 is provided in this final swiveling position, which at the same time represents the secured closed position of the cosmetics unit 1. For this purpose, a latching projection 15 which latches in a way that can be heard and felt into a corresponding latching depression 16 provided at the upper end face of the handle 6 (see FIG. 2 or 3) upon reaching the final swiveling position, is provided on the inside of the bottom of the U of the U-shaped swiveling element 9.

At the outwardly directed frontal surface of the bottom of the U of the U-shaped swiveling element 9, a furrowed profile 17 is provided in order to facilitate an actuation of the swiveling element 9.

The bearing mount 10 is snapped on the storage container 2. This connection cannot be detached again. To this end, a snap-in hook 18 (see FIG. 2) reaches under a corresponding shoulder portion 19 on an opening edge of the storage container 2.

The provision of the cosmetics unit 1 can be carried out easily and, in particular, automatically. For this purpose, the storage container 2 is first filled with the desired cosmetic substance. The swiveling element 9, which can also be referred to as swiveling cap, is mounted on the bearing mount 10 by inserting the bearing pins 11 into the bearing recesses 12. The applicator-handle part 3 is then inserted into the securing mechanism 4, which results in a sub-unit. The latter, in its entirety, is snapped onto the filled storage container 2 in a process step that can also be carried out automatically without any problems. Thus, the cosmetics unit 1 is ready for sale and use.

Figure 4:
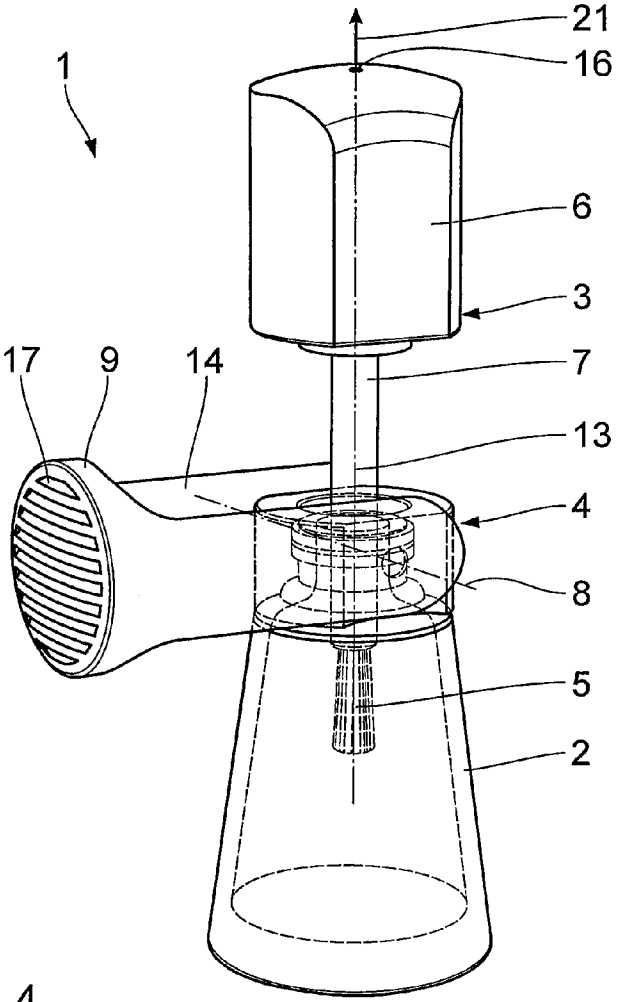
Figure 3:
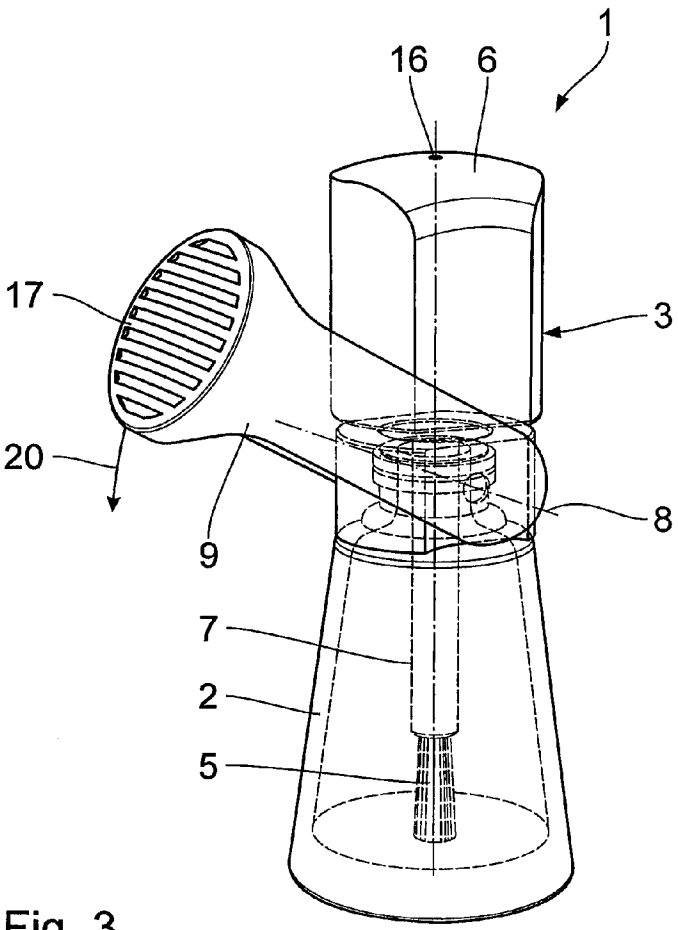

The use of the cosmetics unit 1 is explained in more detail below with reference to the illustrations according to FIGS. 3 and 4. Starting from the final swiveling position, in which the swiveling element 9 grasps the handle 6 and secures the closed position of the cosmetics unit 1 (see FIG. 2), the swiveling element 9 is rotated, in the direction of the swiveling arrow 20 shown in FIG. 3, about the swiveling axis 8 until the opening swiveling position of the swiveling element 9 shown in FIG. 4 is reached. The opening swiveling position is offset relative to the final swiveling position by a swiveling angle of about 90°. This swiveling of the swiveling element 9 can be initiated very easily, if necessary even with only one hand. When the swiveling element 9 is in the opening swiveling position shown in FIG. 4, the applicator-handle part 3 is also released. It can then be withdrawn from the storage container 2 in the direction of the arrow 21 without any problems. After the application of the cosmetic substance, the applicator-handle part 3 is reinserted into the storage container 2 and the swiveling element 9 is swiveled back into the secured final swiveling position. Then, the cosmetics unit 1 is securely and tightly closed again. The latching connection between the swiveling element 9 and the handle 6 prevents the swiveling element 9 from moving out of the final swiveling position on its own leading to an inadvertent opening of the cosmetics unit 1 as a consequence.

Figure 5:
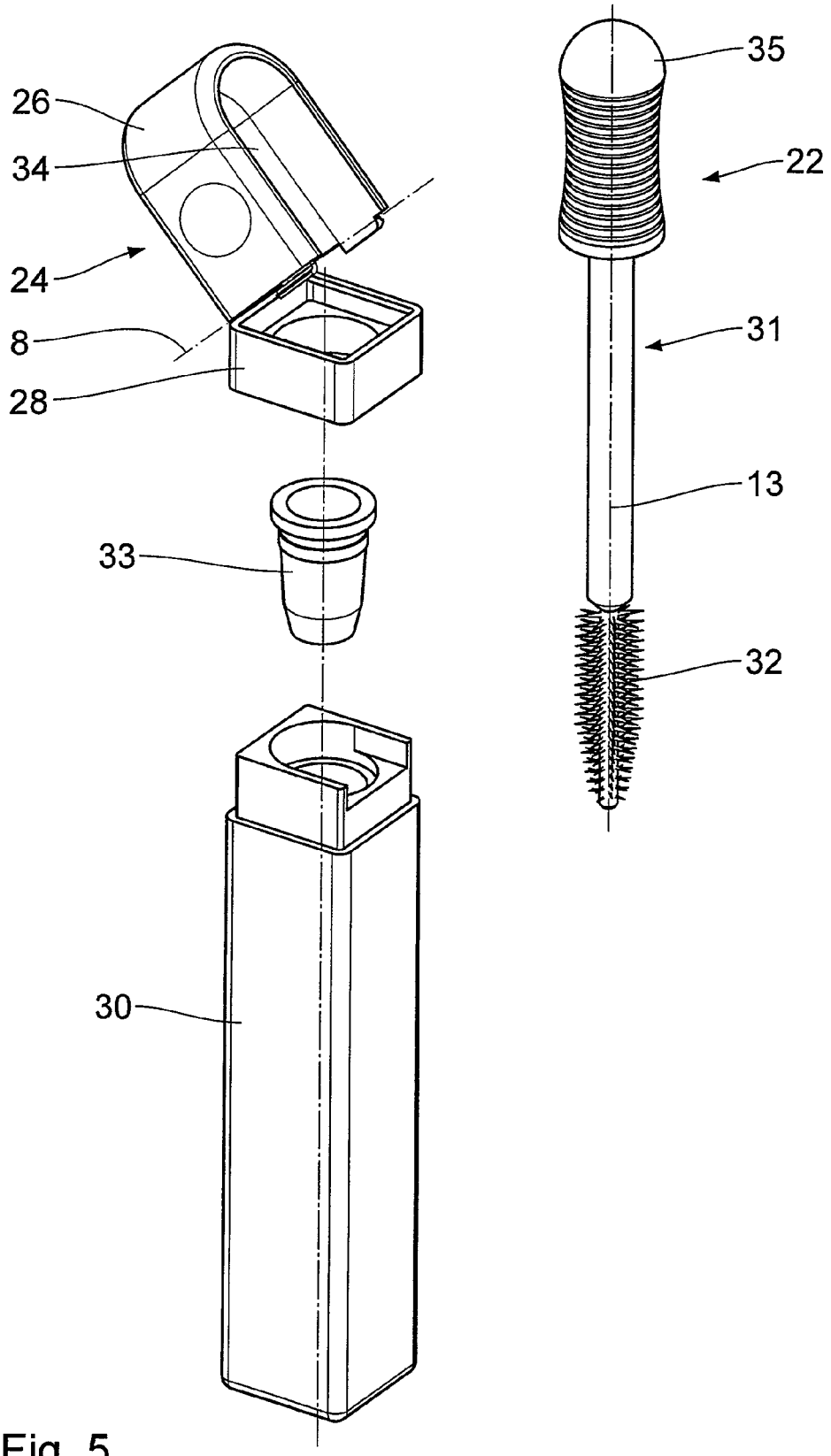
FIGS. 5 to 6 show a second exemplary embodiment of a cosmetics unit with a cap-shaped swiveling mechanism for securing a closed state in a component view and in a view of a state of use.
Figure 6:
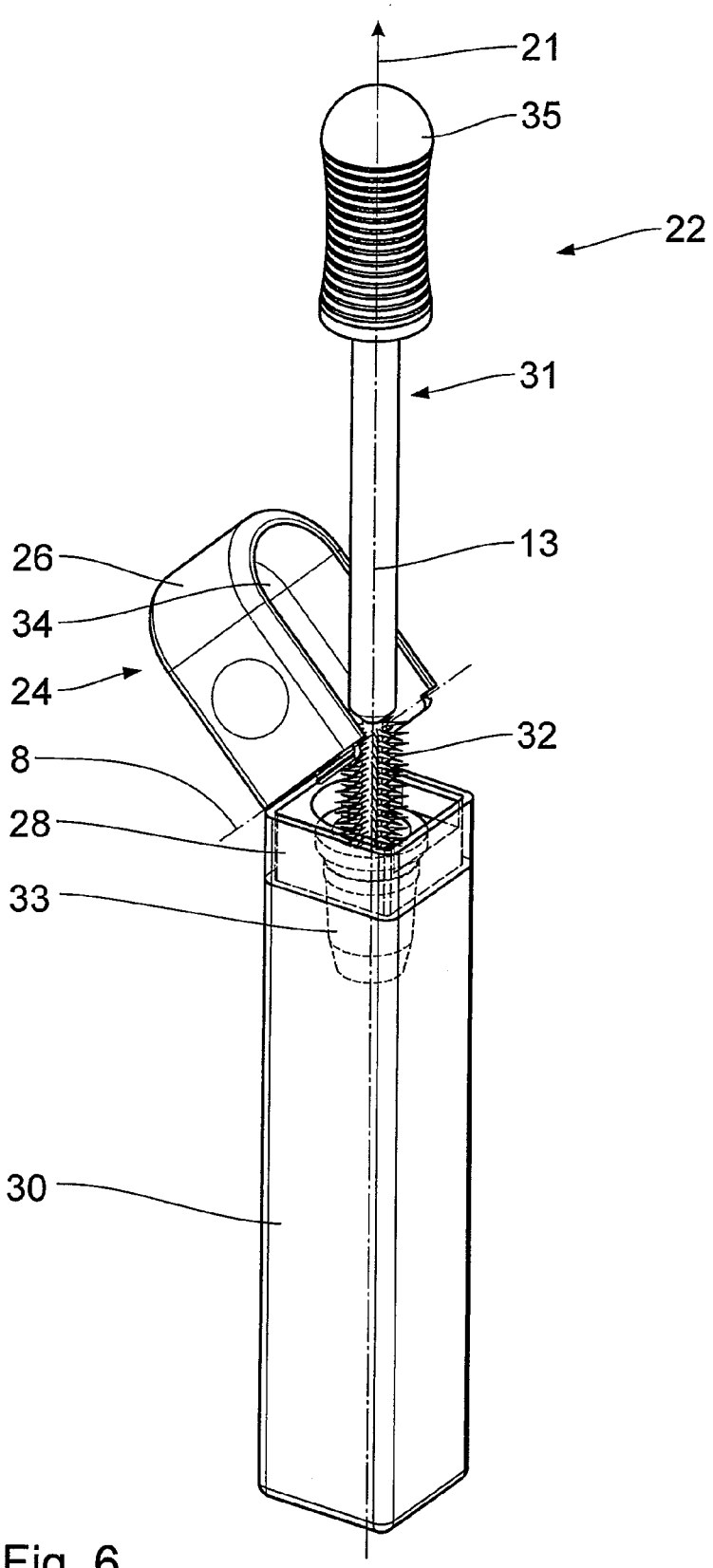

In FIGS. 5 and 6, as well as 7 and 8, two other exemplary embodiments of similar cosmetics units 22 and 23, respectively, are shown. The main difference lies in the configuration of the securing mechanism 24 and 25, respectively, which in each case provides an integral connection of a swiveling element designed as a hinged lid 26 and 27, respectively, with a bearing mount 28 and 29, respectively. The integral connection is realized by a film hinge. Thus, the securing mechanism 24 and 25 in each case consists only of a single component which in turn is placed on a storage container 30. In the cosmetics units 22 and 23, an applicator-handle part 31 is in each case configured for the application of mascara liquid. Therefore, the applicator in this exemplary embodiment is a mascara brush 32. Accordingly, as is common in this case of application, a wiper 33 is inserted into the opening of the storage container 30 along which the mascara brush 32 is passed in order to wipe off excess mascara substance.

The hinged lid 26 provided in the cosmetics unit 22 according to FIGS. 5 and 6 comprises an accommodating space 34, which in a final swiveling position grasps a handle 35 of the applicator-handle part 31 and thus secures the cosmetics unit 22 in the closed position.

Figure 7:
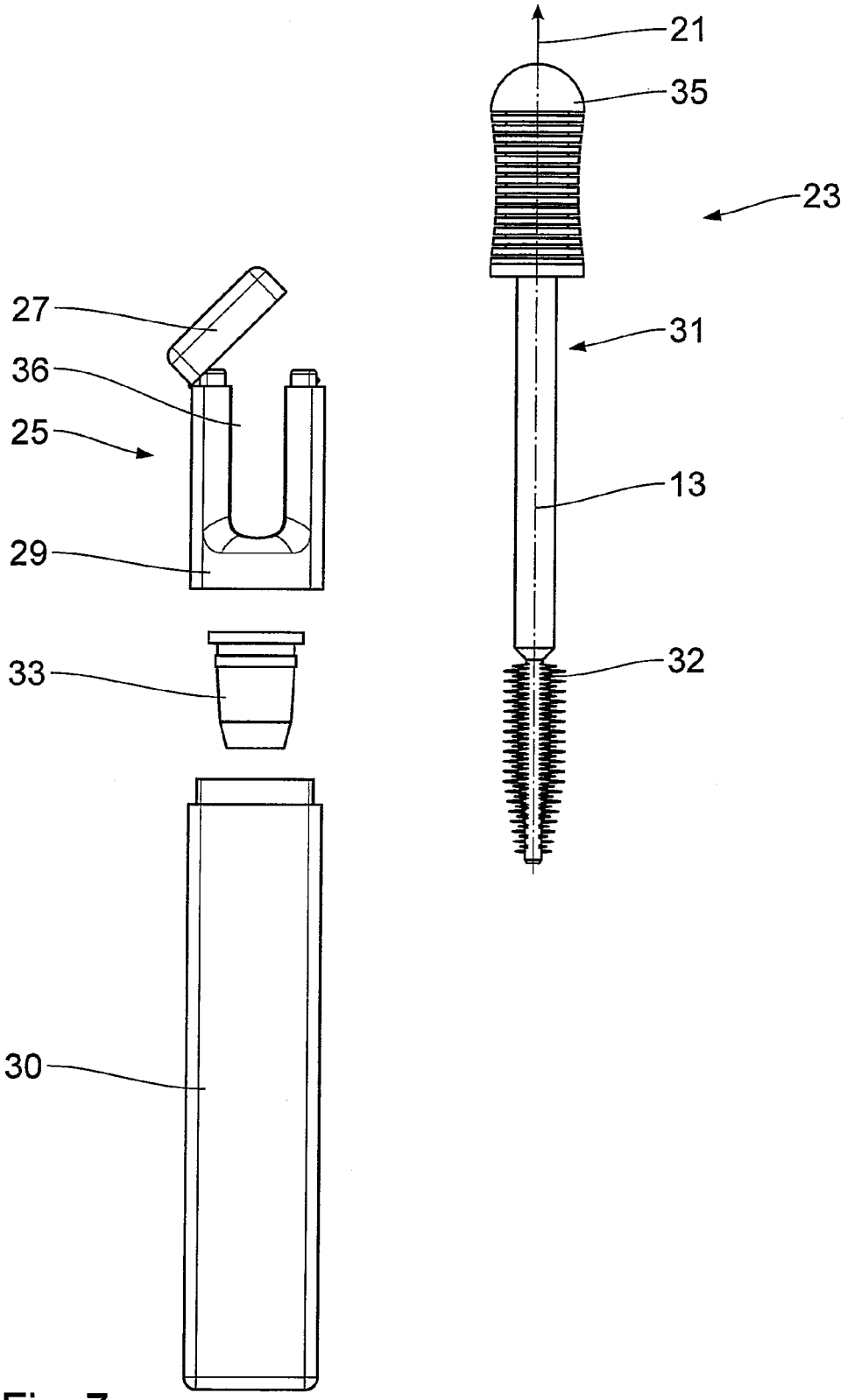
FIGS. 7 to 8 show a third exemplary embodiment of a cosmetics unit with a cap-shaped swiveling mechanism for securing a closed state in a component view and in a view of a state of use.
Figure 8:
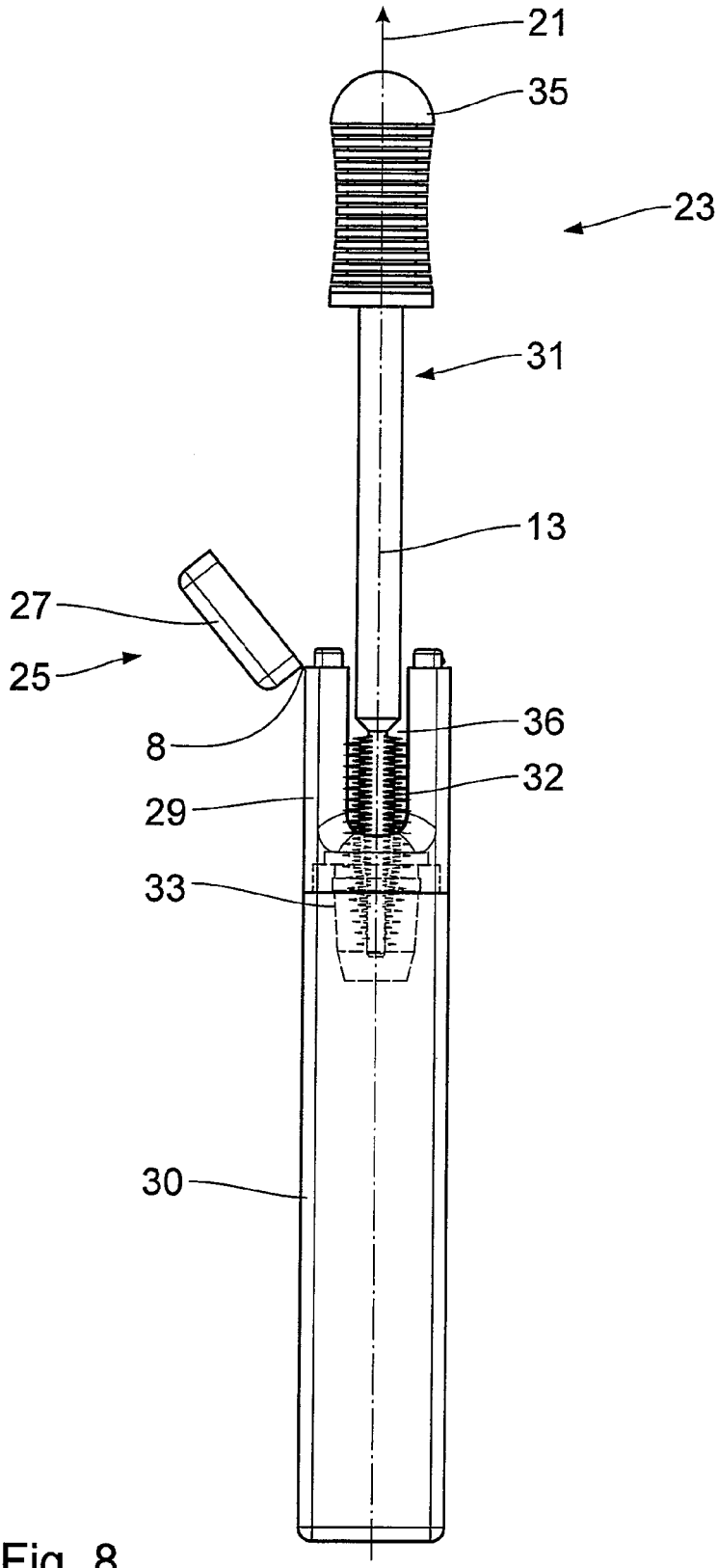

Herein lies a small difference with respect to the cosmetics unit 23 according to FIGS. 7 and 8, in which an accommodating space 36 for the handle 35 is not provided in the hinged lid 27, but in the bearing mount 29. Also in the case of this securing mechanism 25, however, a securing action of the applicator-handle part 31 against it leaving the closed position is achieved by swiveling the hinged lid 27 into its final swiveling position (not shown in FIGS. 7 and 8).

In the case of the securing mechanisms 24 and 25, the final swiveling position is again secured by means of a detachable latching or snap-in connection. This latching or snap-in connection, however, is formed in each case in the exemplary embodiments according to FIGS. 5 to 8 between the hinged lid 26 and 27, respectively, and the associated bearing mount 28 and 29, respectively.

In the opening swiveling position of the respective hinged lid 26 or 27 (see FIGS. 6 and 8, respectively), the applicator-handle part 31 can be withdrawn, as before, in the direction of the arrow 21 from the bottle 30.

Figure 9:
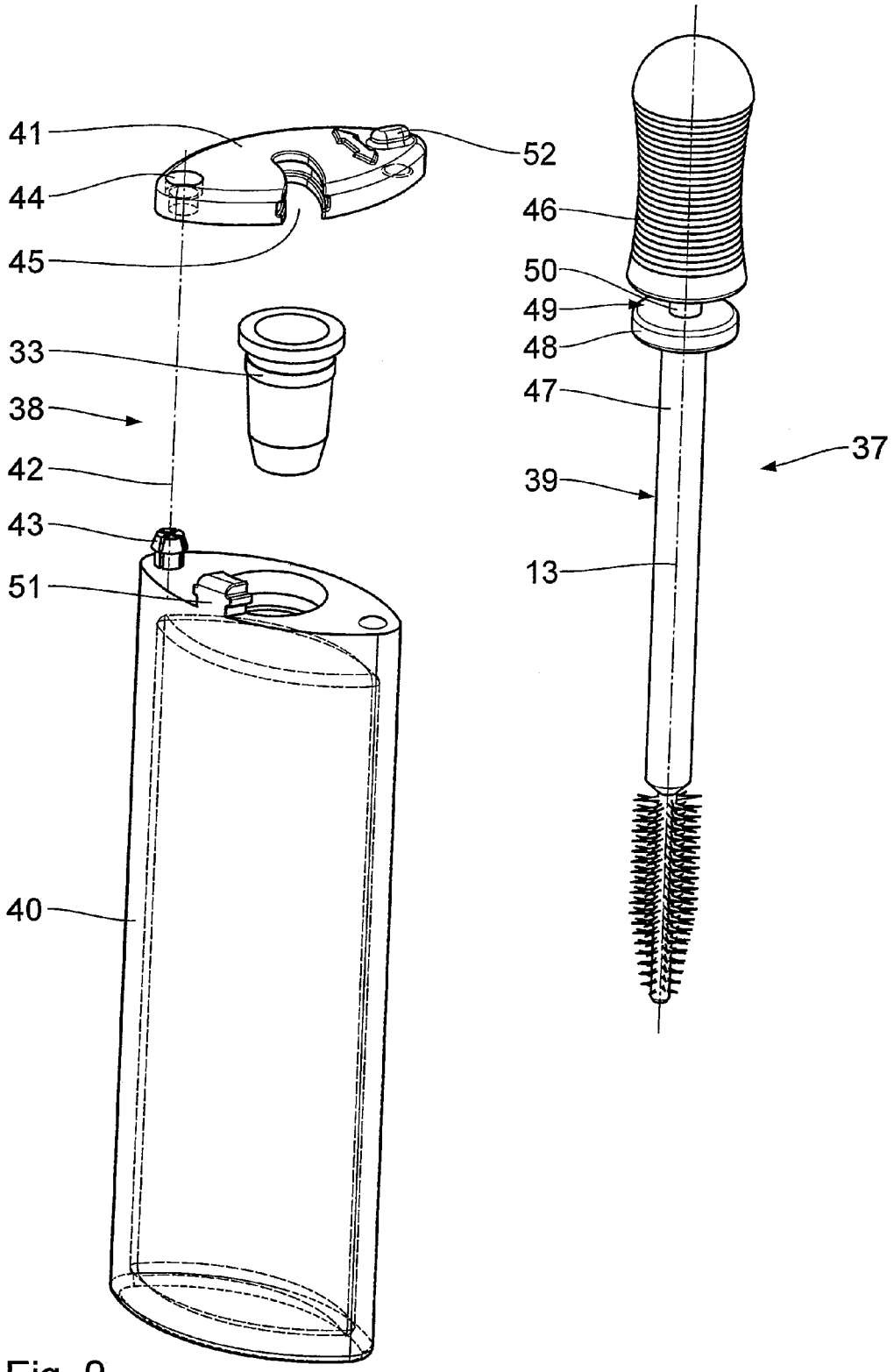
FIGS. 9 to 11 show a fourth exemplary embodiment of a cosmetics unit with a bar-shaped swiveling mechanism for securing a closed state in a component view, in an enlarged detail view, and in a view of a state of use.
Figure 10:
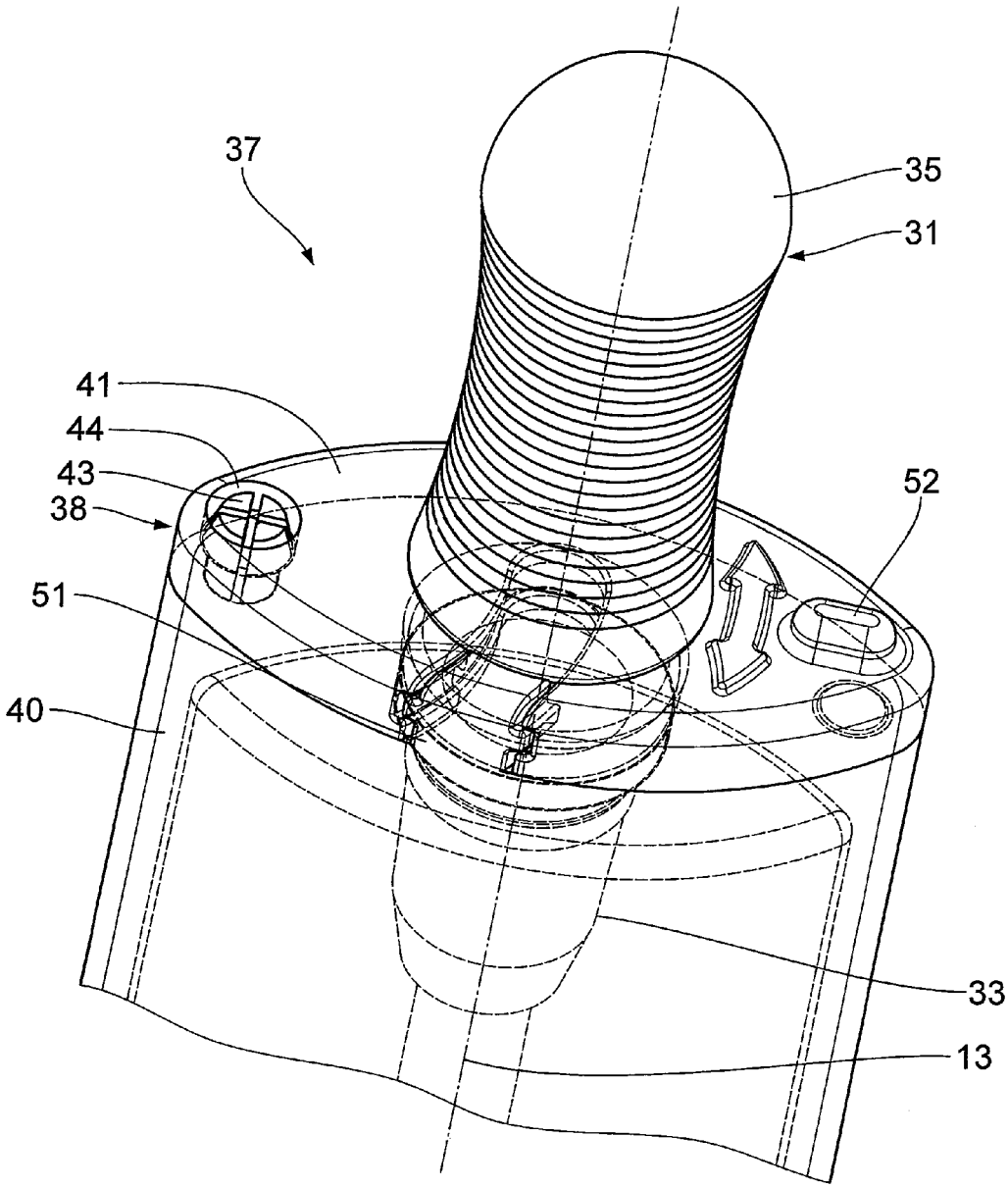
Figure 11:
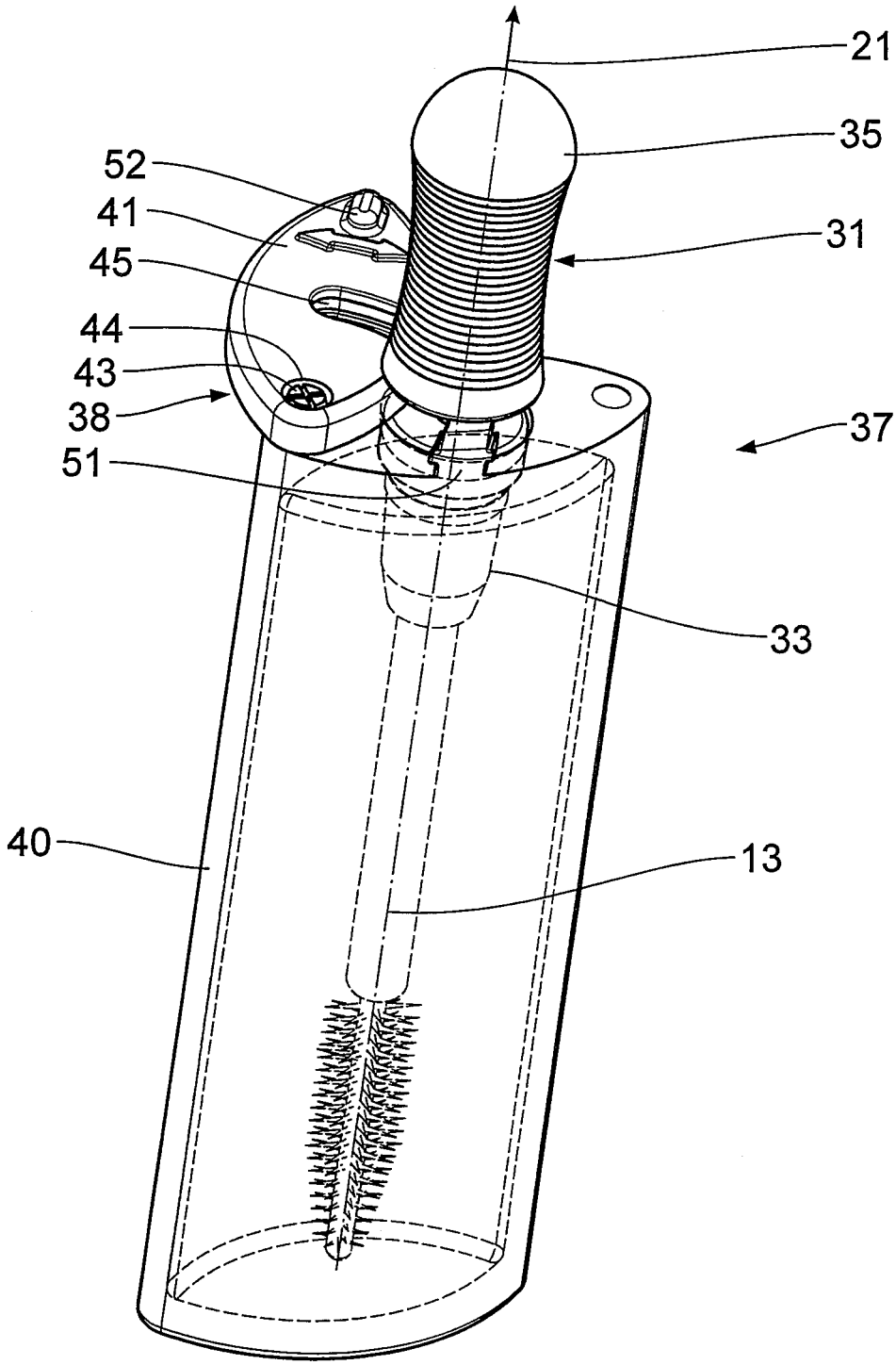

FIGS. 9 to 11 show another exemplary embodiment of a cosmetics unit 37 with a securing mechanism that can be swiveled for securing a closed position of the cosmetics unit 37. Also in the case of the cosmetics unit 37, an applicator-handle part 39, which is also intended for a mascara application, is inserted into a storage container 40, with the container opening once again being equipped with the wiper 33. Though the securing mechanism 38 is also configured to be swiveling, it differs slightly, however, from the securing mechanisms 4, 24 and 25 of the exemplary embodiment described above. It comprises a disc-shaped swiveling bar 41, which can be swiveled about a swiveling axis 42, which in this exemplary embodiment is oriented parallel to the central longitudinal axis 13. The swiveling bar 41 is mounted directly on the storage container 40. To this end, the storage container 40 has at its top end face a bearing pin 43 extending upwards in the direction of the swiveling axis 42. The swiveling bar 41 has a corresponding bearing bore 44 which, in the assembled state, forms a swiveling bearing for the swiveling bar 41, together with the bearing pin 43.

The swiveling bar 41 has a bar recess 45 which has the approximate shape of a circular arc sector and which is in particular disposed concentrically with the bearing bore 44 or the swiveling axis 42, respectively. The bar recess 45, just as the bearing bore 44, passes through, i.e., it extends completely through the swiveling bar 41 in the thickness direction of the swiveling bar 41. The applicator-handle part 39 is configured in a special way underneath a handle 46, in order to cooperate with the swiveling bar 41 and thus cause the closed state of the cosmetics unit 37 to be secured. The applicator-handle part 39 comprises, axially underneath the lower end of the handle 46, a disc-shaped widened portion 48 molded onto the stem 47, so that a handle recess 49 in the shape of a peripheral groove extending in the circumferential direction is formed between the lower end of the handle 46 and the disc-shaped widened portion 48. A rod-shaped connecting portion 50 extends, as an extension of the step 47, within this handle recess 49, which connecting portion 50 connects the disc-shaped widened portion 48 with the handle 46.

In the assembled state, and when the cosmetics unit 37 is closed (see FIG. 10), the swiveling bar 41 is swiveled about the swiveling axis 42 in the direction of the applicator-handle part 39 in such a way that the swiveling bar 41 latches into the handle recess 49, and at the same time, also the rod-shaped connecting portion 50 latches into the bar recess 45. This results in the applicator-handle part 39 being secured very well on the storage container 40. In this final swiveling position, a latch-securing means is provided which is formed between the edge portion of the bar recess 45 and a latching web 51 axially upwardly protruding on an upper end face of the storage container 40. Moreover, a handle web 52 located at an end of the swiveling bar 41 opposite to the bearing bore 44 is disposed on an upper side of the swiveling bar 41 for actuation.

If the swiveling bar 41, starting from the final swiveling position shown in FIG. 10, is brought by about 180° about the swiveling axis 42 into an opening swiveling position shown in FIG. 11, the applicator-handle part 39 can again be withdrawn from the storage container 40 in the direction of the arrow 21.

Figure 12:
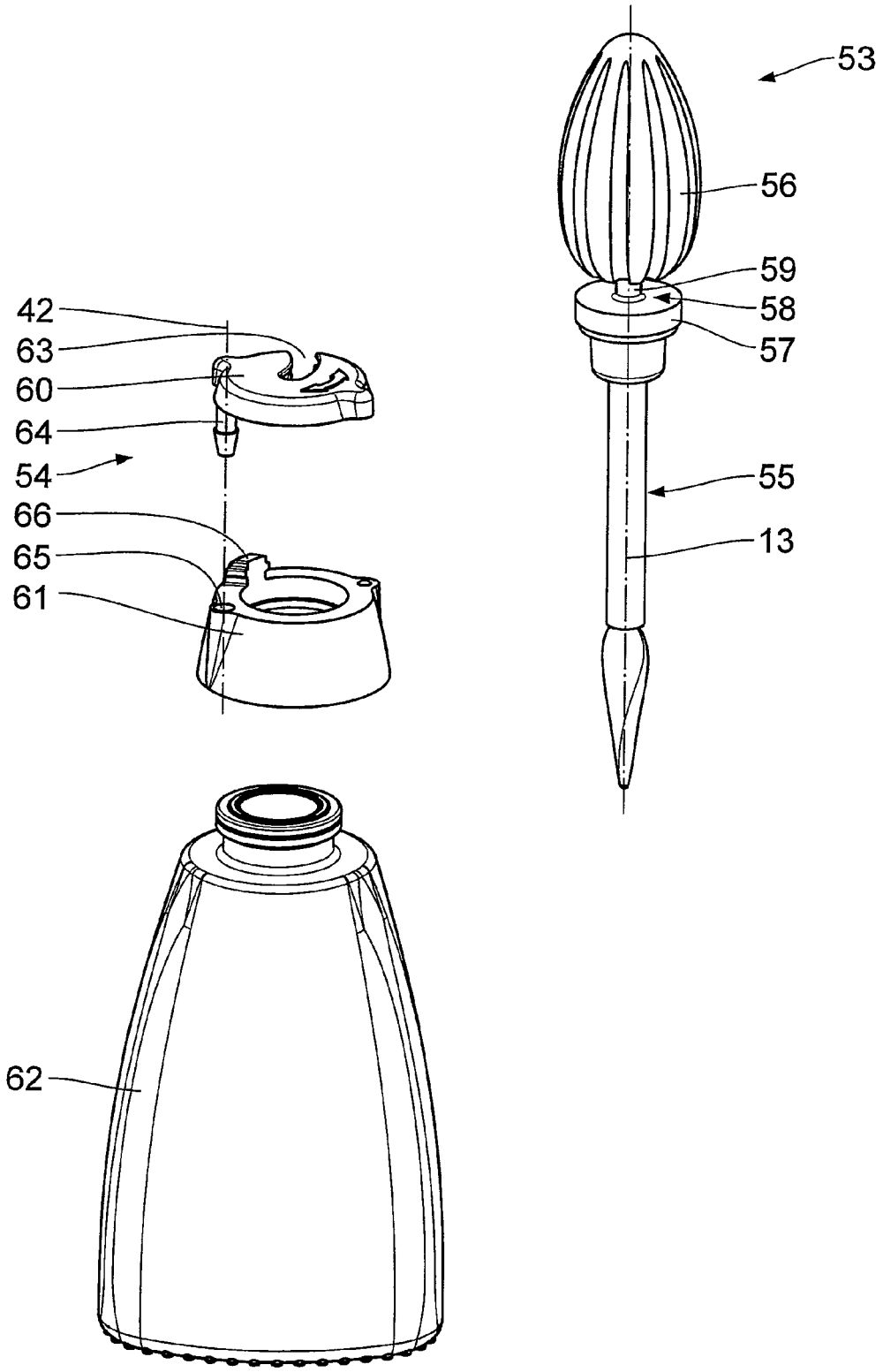
FIGS. 12 to 13 show a fifth exemplary embodiment of a cosmetics unit with a bar-shaped swiveling mechanism for securing a closed state in a component view and in an enlarged view of the swiveling mechanism.
Figure 13:
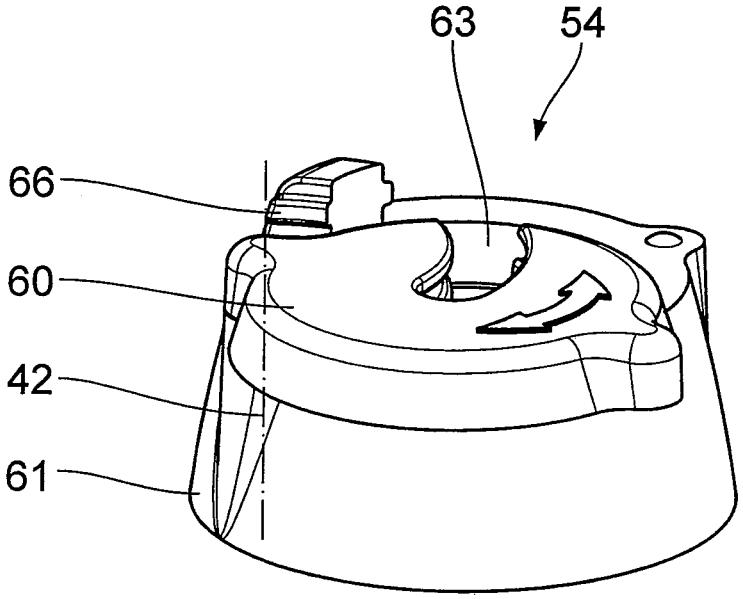

The further exemplary embodiment of a cosmetics unit 53 shown in FIGS. 12 and 13 has a swiveling securing mechanism 54 similar to that of the cosmetics unit 37 according to FIGS. 9 to 11. An applicator-handle part 55 of the cosmetics unit 53 also comprises, between a handle 56 and a widened portion 57 disposed axially thereunder, a handle recess 58 formed as a peripheral groove, within which a rod-shaped connecting portion 59 is provided. A disc-shaped swiveling bar 60 of the securing mechanism 54 is mounted on a storage container 62 by means of a bearing mount 61 so that it can be swiveled about the swiveling axis 42. Similar to the swiveling bar 41, the swiveling bar 60 has a circular arc-shaped bar recess 63 and cooperates with the handle recess 58 and the rod-shaped connecting portion 59 in the same way as described in the preceding exemplary embodiment. In the case of the cosmetics unit 53, the swivel bearing of the securing mechanism 54 is formed corresponding to the mechanical reversal of the swivel bearing of the cosmetics unit 37. For the swiveling bar 60 does not have any bearing bore, but rather, on its underside, a bearing pin 64 which extends axially downwardly and pivotably engages into a corresponding bearing bore 65 on the bearing mount 61.

For guidance of the swiveling bar 60 shortly before reaching the final swiveling position, an axially upwardly protruding guiding web 66 is provided on an upper side of the bearing mount 61, the guiding web cooperating with an edge portion of the bar recess 63, thus providing guidance. A latching mechanism for the final swiveling position of the swiveling bar 60 is also provided in the securing mechanism 54 of the cosmetics unit 53.

The invention claimed is:

1. Cosmetics unit, comprising a) a storage container for receiving a cosmetic substance, b) an applicator-handle part with an applicator that can be dipped into the cosmetic substance and with a handle connected with the applicator, and c) a securing mechanism for detachably securing the applicator-handle part in a closed position in which the applicator is inserted into the storage container;

wherein d) the securing mechanism comprises a swiveling element that can be swiveled about a swiveling axis, d1) which retains, in a final swiveling position, the applicator-handle part in the closed position, and d2) which is mounted on a separate bearing mount attached to the storage container, wherein the bearing mount is non-detachably snapped onto a bottle neck of the storage container with a snap-in hook that reaches under a corresponding shoulder portion of the bottle neck, and the storage container can be filled before snapping the bearing mount onto the bottle neck of the storage container, and wherein the swiveling element has a U-shaped cross-section comprising two legs of the U and a bottom of the U, with a swiveling support being provided in the area of the free ends of the two legs of the U, the swiveling support comprising a bearing pin on each inside surface of the two legs of the U, wherein each of the bearing pins engages into an associated bearing recess on a side surface of the bearing mount.

2. Cosmetics unit according to claim 1, characterized in that the swiveling axis extends perpendicularly to a central longitudinal axis of the applicator-handle part to be secured.

3. Cosmetics unit according to claim 1, characterized in that the swiveling element or the bearing mount has an accommodating space which partially encloses the handle in the closed position.

4. Cosmetics unit according to claim 1, characterized in that the swiveling element is secured in the final swiveling position by means of a detachable latching or snap-in connection.

* * * * *